US009561520B2

(12) United States Patent
Metaxatos et al.

(10) Patent No.: US 9,561,520 B2
(45) Date of Patent: Feb. 7, 2017

(54) SPRAYER WITH SELECTIVELY PIVOTABLE AND LOCKABLE ATTACHMENT-MOUNTING ARM

(71) Applicants: Paul Metaxatos, Swampscott, MA (US); James McGee, Winthrop, MA (US); Julie Chiappari, Arlington, MA (US); Joel Nevin, Portsmouth, MA (US); Richard M. Farland, Fiskdale, MA (US); Corey Talbot, Hebron, CT (US)

(72) Inventors: Paul Metaxatos, Swampscott, MA (US); James McGee, Winthrop, MA (US); Julie Chiappari, Arlington, MA (US); Joel Nevin, Portsmouth, MA (US); Richard M. Farland, Fiskdale, MA (US); Corey Talbot, Hebron, CT (US)

(73) Assignee: HYDE TOOLS, Inc., Southbridge, MA (US)

( * ) Notice: Subject to any disclaimer, the term of this patent is extended or adjusted under 35 U.S.C. 154(b) by 36 days.

(21) Appl. No.: 14/269,193

(22) Filed: May 4, 2014

(65) Prior Publication Data

US 2015/0008269 A1 Jan. 8, 2015

Related U.S. Application Data

(60) Provisional application No. 61/820,840, filed on May 8, 2013.

(51) Int. Cl.
*A62C 31/24* (2006.01)
*B05B 13/02* (2006.01)
(Continued)

(52) U.S. Cl.
CPC ..... *B05B 13/0278* (2013.01); *A47L 13/26* (2013.01); *B08B 3/028* (2013.01); *B05B 13/005* (2013.01)

(58) Field of Classification Search
CPC .... B05B 13/0278; B05B 13/005; A47L 13/26; B08B 3/028
(Continued)

(56) References Cited

U.S. PATENT DOCUMENTS 6,216,965 B1 4/2001 Chao
6,336,764 B1 * 1/2002 Liu ..... A46B 11/06 15/144.1
(Continued)

*Primary Examiner* — Justin Jonaitis
(74) *Attorney, Agent, or Firm* — Louis J. Franco; Law Office of Louis J. Franco

(57) ABSTRACT

A fluid sprayer includes a rigid fluid conduit extending along a conduit axis between longitudinally opposed open conduit first and second ends. A spray nozzle having a fluid-expulsion bore is connected to the conduit second end such that the nozzle can pivot about a nozzle-pivot axis that extends orthogonally to the conduit axis and fluid introduced into the conduit first end is expelled through the fluid-expulsion bore. An attachment-mounting arm is connected to the fluid conduit for pivotal movement about an arm-pivot axis having a component of spatial extension orthogonal to the conduit axis and being longitudinally non-displaceable relative to the rigid fluid conduit. Moreover, the attachment-mounting arm is selectively lockable into a plurality of discrete angular positions relative to the conduit and configured to removably retain a surface-engaging attachment designed for engaging a surface to be cleaned.

11 Claims, 5 Drawing Sheets

(51) Int. Cl.

| | |
|---|---|
| ***B08B 3/02*** | (2006.01) |
| ***A47L 13/26*** | (2006.01) |
| *B05B 13/00* | (2006.01) |

(58) Field of Classification Search
USPC ..... 239/525, 532, 531, 280
See application file for complete search history.

(56) References Cited

U.S. PATENT DOCUMENTS

| | | | | |
|---|---|---|---|---|
| 6,511,001 | B1 * | 1/2003 | Huang | B05B 15/066 239/526 |
| 6,595,439 | B1 * | 7/2003 | Chen | B05B 15/066 239/225.1 |
| 6,685,115 | B1 * | 2/2004 | Hardin | B05B 15/066 239/280 |
| 7,927,033 | B2 * | 4/2011 | Gansebom | A46B 5/0095 401/139 |
| 8,245,957 | B2 * | 8/2012 | Zhang | B05B 15/066 239/532 |
| 2008/0083844 | A1 * | 4/2008 | Leber | B05B 15/066 239/600 |
| 2009/0065607 | A1 | 3/2009 | Gardner et al. | |
| 2011/0017846 | A1 * | 1/2011 | Baxter | B05B 15/066 239/587.1 |
| 2012/0187215 | A1 | 7/2012 | Kirkpatrick | |

* cited by examiner

SPRAYER WITH SELECTIVELY PIVOTABLE AND LOCKABLE ATTACHMENT-MOUNTING ARM

PROVISIONAL PRIORITY CLAIM

Priority based on Provisional Application, Ser. No. 61/820,840 filed May 8, 2013, and entitled "SPRAYER WITH SELECTIVELY PIVOTABLE AND LOCKABLE ATTACHMENT-MOUNTING ARM" is claimed. Moreover, the entirety of the previous provisional application, including the drawings, is incorporated herein by reference as if set forth fully in the present application.

BACKGROUND

Sprayers and spray wands are configured for various purposes including washing objects with water expelled at high velocity. Such apparatus are commonly referred to as "pressure washers." Pressure washers may be used to wash autos, homes and other objects or structures. Such spraying operations are frequently accompanied by the need to mechanically engage the surface being sprayed with a surface-engaging implement such as a sponge or brush in order to scrub the surface. Most often, surface scrubbing requires that a user set aside the spray wand in order to grasp and manipulate the surface-engaging implement.

In recognition of the inconvenience and time-consuming nature of using alternative implements to rinse and scrub surfaces, limited attempts have been made to provide implements that can serve either function. One such implement is a brush that is attachable to a hose or wand with a trigger and has water-ejecting apertures in the same platform or body from which the bristles extend. When the brush is being use for scrubbing, the water flow to the brush can be interrupted. When rinsing is desired, the water flow can be activated and water emits from between the bristles. While perhaps an improvement over older methods of switching between implements to scrub and rinse, such apparatus are limited in their utility because they do not yield the high velocity water-ejection facilitated by a pressure washer nozzle.

Accordingly, a need exists for a sprayer the effectively facilitates convenient scrubbing and high-pressure rinsing of surfaces to be cleaned.

SUMMARY

In each of various alternative embodiments, a sprayer for spraying pressurized fluids (i.e., liquids, gases or liquid/gas mixtures, soap/water mixtures, etc.) includes a rigid fluid conduit extending along a conduit axis between longitudinally opposed conduit first and second ends. A conduit side wall has an exterior surface and an interior surface defining an internal fluid passage that extends between the conduit first and second ends. The conduit first and second ends include, respectively, a fluid-entrance opening through which fluid can be introduced into the fluid channel and a fluid-exit opening through which fluid can exit the fluid channel.

Attached to the conduit second end is a spray nozzle including a nozzle housing with opposed fluid-entrance and fluid-expulsion bores. An interior fluid channel for rendering the fluid-entrance and fluid-expulsion bores in mutual fluid communication extends longitudinally through the nozzle housing along a fluid-channel axis. The nozzle housing is connected to the conduit second end with the internal fluid passage and interior fluid channel in fluid communication such that pressurized fluid introduced into the fluid conduit through the fluid-entrance opening passes through the internal fluid passage and the interior fluid channel for expulsion through the fluid-expulsion bore of the nozzle housing. Moreover, the nozzle housing is connected to the second end of the fluid conduit for pivotal movement about a nozzle-pivot axis having a component of spatial extension orthogonal to each of the conduit axis and the fluid-channel axis such that the angular orientation of the fluid-channel axis relative to the conduit axis can be altered in order to change the spray angle at which fluid is expelled through the fluid-expulsion bore.

An attachment-mounting arm is connected to the fluid conduit for pivotal movement about an arm-pivot axis having a component of spatial extension orthogonal to the conduit axis. In some versions, the arm-pivot and nozzle-pivot axes are collinear, an arrangement more full explained in the detailed description. In still other versions, the arm-pivot axis is longitudinally non-displaceable relative to the rigid fluid conduit, irrespective of whether it is collinear with the nozzle-pivot axis.

In each of various embodiments, the attachment-mounting arm is selectively lockable into a plurality of discrete angular positions relative to the fluid conduit. According to one broadly illustrative version, the attachment-mounting arm—which extends between first and second arm ends along an arm axis—includes at its first end a bore extending transversely to the arm axis and defined by a cylindrical interior bore surface. Depending from the rigid conduit is an axle that extends transversely to the conduit axis and includes a cylindrical exterior axle surface configured for receiving the interior bore surface thereover such that the cylindrical interior bore and exterior axle surfaces are coaxially centered on the arm pivot axis, and the interior bore surface defines a hub that is pivotable about the axle.

In order to define plural locking positions and facilitate selective locking into each of the same, the axle and hub are illustratively configured as follows. The hub defines at least one of a notch and protrusion. Similarly, the axle defines at least one of a protrusion and notch. The hub is axially displaceable over the axle along the arm-pivot axis between axial first and second positions. In the axial first position, arm pivoting is prevented by an engaged interference fit between one of a protrusion and notch defined by the axle and the other of a notch and protrusion defined by the hub. Conversely, in the axial second position, the interference fit is disengaged so that the arm is free to pivot about the arm-pivot axis for selective rotation into another angular position in to which it can be locked. In order to maintain the attachment-mounting arm in a selected locked angular position, the hub is normally mechanically biased toward the axial first position by a biasing member such as a coiled spring, by way of non-limiting example.

In an illustrative embodiment, the attachment-mounting arm is configured to removably retain a surface-engaging attachment that is itself configured for engaging a surface to be cleaned. The surface-engaging attachment comprises a platform and a mounting post attached to and extending from the platform. The attachment-mounting arm and mounting post are selectively coupleable to one another such that one of the attachment-mounting arm and mounting post is telescopically received into the other of the mounting post and attachment-mounting arm. In one version, the mounting post is fixedly attached to the platform, while in another, alternative version, the mounting post and platform are pivotably connected to one another for angular movement about at least one post-pivot axis in order to facilitate a degree of angular movement of the platform relative to the conduit that is greater than that degree of movement facilitated by a configuration in which the platform and mounting post are mutually "fixed."

Representative embodiments are more completely described and depicted in the following detailed description and the accompanying drawings.

DETAILED DESCRIPTION

The following description of variously embodied fluid sprayers is demonstrative in nature and is not intended to limit the invention or its application of uses. Accordingly, the various implementations, aspects, versions and embodiments described in the summary and detailed description are in the nature of non-limiting examples falling within the scope of the appended claims and do not serve to restrict the maximum scope of the claims.

Figure 1:
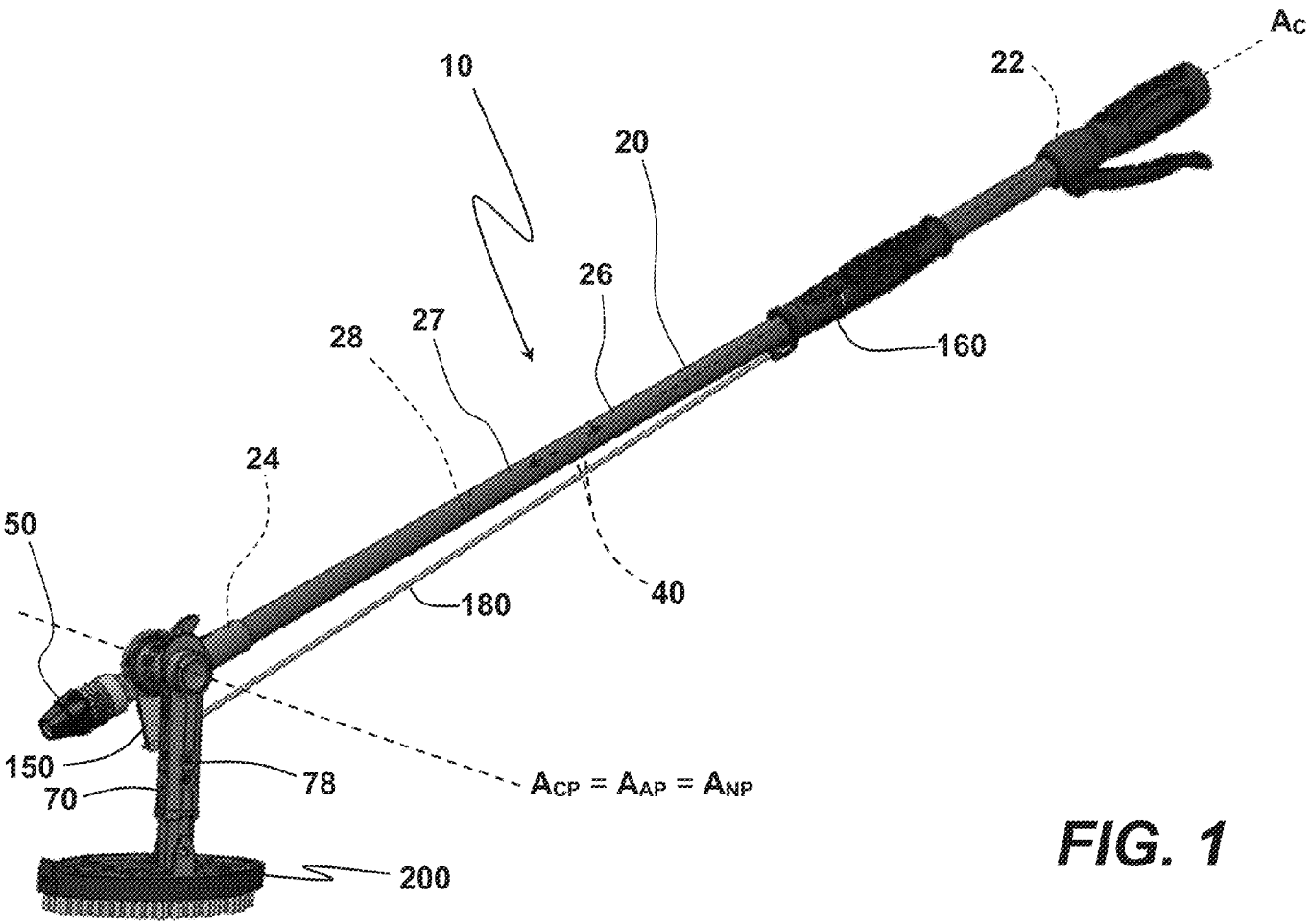
FIG. 1 is a left side view of an assembled illustrative sprayer with a selectively pivotable and lockable attachment-mounting arm.
Figure 2:
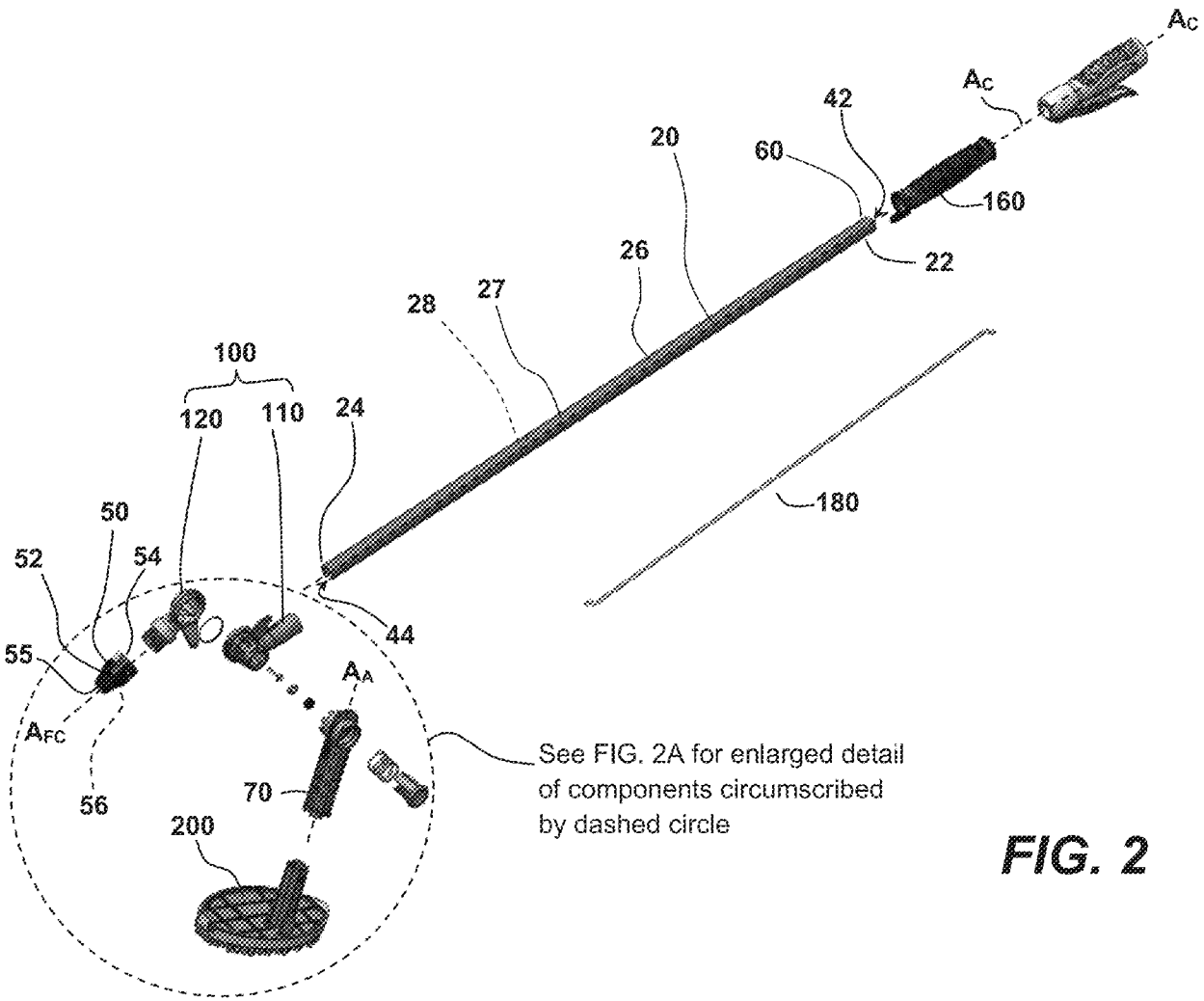
FIG. 2 is a left side exploded view of the sprayer of FIG. 1.

Referring initially to the assembled and exploded views of, respectively, FIGS. 1 and 2, an illustrative sprayer 10 includes a rigid fluid conduit 20 that extends along a conduit axis $A_C$ between longitudinally opposed conduit first and second ends 22 and 24. A conduit side wall 26 has an exterior surface 27 and an interior surface 28 defining an internal fluid passage 40 that extends between the conduit first and second ends 22 and 24. The conduit first and second ends 22 and 24 include, respectively, a fluid-entrance opening 42 through which fluid can be introduced into the fluid passage 40 and a fluid-exit opening 44 through which fluid can exit the fluid passage 40.

Figure 2A:
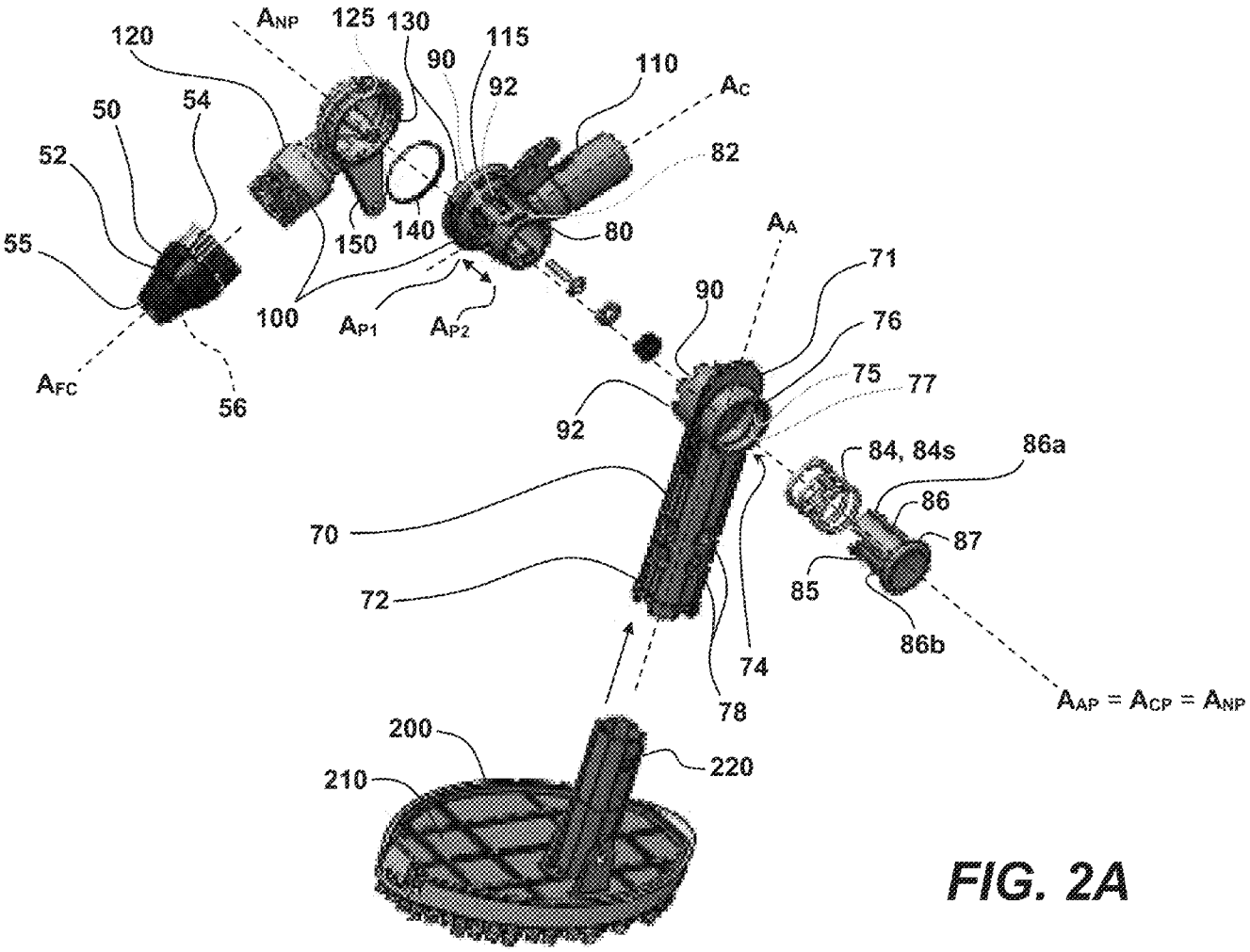
FIG. 2A is an enlarged detail view of the components circumscribed by the dashed circle in FIG. 2.

With continued reference to FIGS. 1 and 2, and additional reference to FIG. 2A, the latter being an enlarged detail view of the components circumscribed by a dashed circle in FIG. 2, a spray nozzle 50 is attached to the conduit second end 24. The spray nozzle 50 has a nozzle housing 52 with opposed fluid-entrance and fluid-expulsion bores 54 and 55. An interior fluid channel 56 renders the fluid-entrance and fluid-expulsion bores 54 and 55 in mutual fluid communication and extends longitudinally through the nozzle housing 52 along a fluid-channel axis $A_{FC}$. The nozzle housing 52 is connected to the conduit second end 24 with the fluid passage 40 and fluid channel 56 in fluid communication such that pressurized fluid introduced into the fluid-entrance opening 42 of the fluid conduit 20 passes through the fluid passage 40 and the fluid channel 56 for expulsion through the fluid-expulsion bore 55 of the nozzle housing 52.

Referring still to FIGS. 1, 2 and 2A, an attachment-mounting arm 70 is connected to the fluid conduit 20 for pivotal movement about an arm-pivot axis $A_{AP}$ having a component of spatial extension orthogonal to the conduit axis $A_C$. The attachment-mounting arm 70 extends along an arm axis $A_A$ between arm first and second ends 71 and 72, and is selectively lockable into a plurality of discrete angular positions relative to the conduit axis $A_C$. While, in the illustrative embodiments of FIGS. 1, 2 and 2A, the angle between the arm axis $A_A$ and the conduit axis $A_C$ can be changed by pivoting the attachment-mounting arm 70 about the arm-pivot axis $A_{AP}$, the arm-pivot axis $A_{AP}$ itself is longitudinally non-displaceable relative to the rigid fluid conduit 20. That is, the lineal position of the arm-pivot axis $A_{AP}$ along the conduit axis $A_C$ is fixed.

Although referenced to the extent practicable in FIGS. 1 and 2, representative components facilitating pivotal displacement and selective angular locking of the attachment-mounting arm 70 relative to the fluid conduit 20 are most clearly depicted in the enlarged exploded view of FIG. 2A. More specifically, the arm first end 71 includes a bore 74 that extends transversely relative to the arm axis $A_A$ and is defined by a cylindrical interior bore surface 75. Depending from the rigid conduit 20 is an axle 80 that extends transversely to the conduit axis $A_C$ and includes a cylindrical exterior axle surface 82 configured for receiving the interior bore surface 75 thereover such that the cylindrical interior bore surface 75 and exterior axle surface 82 are coaxially centered on the arm-pivot axis $A_{AP}$ and the interior bore surface 75 defines a hub 76 that is pivotable about the axle 80.

With continued principal reference to FIG. 2A, the attachment-mounting arm 70 is selectively lockable into a plurality of discrete angular positions relative to the conduit axis $A_C$ as follows. The hub 76 defines at least one of a notch 90 and protrusion 92. Similarly, the axle 80 defines at least one of a notch 90 and protrusion 92. The hub 76 is axially displaceable over the axle 80 along the arm-pivot axis $A_{AP}$ between (i) an axial first position $A_{P1}$ in which pivoting of the arm 70 is prevented by an engaged interference fit between one of a protrusion 92 and notch 90 defined by the axle 80 and the other of a notch 90 and protrusion 92 defined by the hub 76 and (ii) an axial second position $A_{P2}$ in which the interference fit is disengaged so that the arm 70 is free to pivot about the arm-pivot axis $A_{AP}$ for selective locking into disparate angular positions.

In each of various embodiments, the hub 76 is normally biased toward the axial first position $A_{P1}$. In the particular illustrative version of FIGS. 1-2A, mechanical bias toward the first position $A_{P1}$ is accomplished by a biasing member 84; in the present case, a coiled spring $\mathbf{84}_S$. Moreover, as indicated in FIG. 2A, a cap 85 with a cap stem 86 which, at a first end 86*a* is coupled to the axle 80, and, at a second end 86*b*, terminates in a flanged head 87 is fitted into the axle 80 and fixedly retained thereby. The coiled spring 84*s* is helically disposed about the cap stem 86 and compressed between the flanged head 87 and an inwardly-extending shoulder 77 defined along the interior bore surface 75 of the bore 74 extending through the hub 76. When the components are assembled, the coiled spring 84*s* is at least partially compressed in order to bias the arm 70 toward the axial first position $A_{P1}$ of angular locking engagement. When a change in angular position is desired, a user applies a force in opposition to the biasing force of the spring 84*s*, thereby further compressing the spring 84*s* and drawing the arm 70 and hub 76 toward the axial second position $A_{P2}$ in which the hub 76 and, by extension, the arm 70 are free to pivot about the axle 80.

Once a desired arm angle is achieved, the user releases the arm 70 and allows the hub 76 to bias toward the axial first position $A_{P1}$ for locking engagement at the newly-selected angle. While drawing the hub 76 toward the axial second position $A_{P2}$, a user can support his or her thumb (not shown) on the flanged head 87 while drawing the arm 70 with the hub 76 situated between two other fingers (not shown). When this is done, the flanged head 87 will appear "depressed" relative to the hub 76. For this reason, the cap 85, and particularly the flanged head 87 thereof, is alternatively referred to as a "button."

In various versions, including the one depicted in FIGS. 1-2A, the nozzle housing 52 is attached to the conduit second end 24 for pivotal movement about a nozzle-pivot axis $A_{NP}$ having a component of spatial extension perpendicular to each of the conduit axis $A_C$ and the fluid-channel axis $A_{FC}$ such that the angular orientation of the fluid-channel axis $A_{FC}$ relative to the conduit axis $A_C$ can be changed. Illustrative components facilitating pivotal displacement of the nozzle housing 52 relative to the fluid conduit 20 are shown in FIGS. 2 and 2A, the latter being an exploded view of the components shown in FIG. 2.

With principal reference to FIG. 2A, the nozzle housing 52 is connected to the rigid fluid conduit 20 via a pivotable connector assembly 100—alternatively referred to as "pivot head 100." The pivot head 100 includes a first connector portion 110 connected to the conduit second end 24 and a second connector portion 120 that retains the nozzle housing 52. The first connector portion 110 is fixedly attached to the conduit second end 24, and is therefore alternatively referred to—while using the same reference number—as the "pivot-head static component 110." The second connector portion 120 is rotatably coupled to the pivot-head static component 110, and is alternatively referred to as the "pivot-head rotating component 120." In addition to being coupled for rotation relative to each other, the pivot-head static and rotating components 110 and 120 are mutually coupled such that there is defined between—and partially through—them a liquid-tight fluid chamber 130. When the pivot-head static and rotating components 110 and 120 are cooperatively coupled, the fluid chamber 130 defined thereby is in fluid communication with each of (i) the fluid passage 40 of the fluid conduit 20 and (ii) the fluid channel 56 of the spray nozzle 50 such that pressurized fluid introduced into the fluid-entrance opening 42 of the fluid conduit 20 passes through the fluid passage 40 and the fluid channel 56 for expulsion through the fluid-expulsion bore 55 of the nozzle housing 52.

With continuing reference to FIG. 2A, it can be seen that the regions of the pivot-head static and rotating components 110 and 120 that mutually couple are of circular configuration, so as to facilitate their relative rotation. More specifically, the pivot-head static component 110 includes a first rotation-bearing surface 115 that bears against a second rotation-bearing surface 125 defined and carried by the pivot-head rotating component 120. In the embodiment depicted, an O-ring 140 facilitates a fluid-tight seal between the pivot-head static and rotating components 110 and 120.

Referring still to FIG. 2A, it will be readily appreciated that the circular first and second rotation-bearing surfaces 115 and 125 are centered on—and define—the nozzle-pivot axis $A_{NP}$. Moreover, in the illustrative embodiment of FIG. 1-2A, the nozzle-pivot axis $A_{NP}$ is defined "in common" with the arm-pivot axis $A_{AP}$. That is, from the standpoint of a line or axis defined in Cartesian space, the nozzle-pivot axis $A_{NP}$ and arm-pivot axis $A_{AP}$ are one and the same, and may therefore be jointly or severely referred to as a "common pivot axis $A_{CP}$" or as being "co-axial" or "collinear" with one another and with or along a common pivot axis $A_{CP}$. Relatedly, for purposes of facilitating the "co-axial" or "collinear" alignment of the nozzle-pivot axis $A_{NP}$ and arm-pivot axis $A_{AP}$, the pivot-head static component 110 defines and carries both the first rotation-bearing surface 115 and the axle 80 about which, respectively, the pivot-head rotating component 120 and the hub 76 of the attachment-mounting arm 70 pivot.

Although the particular manner in pivoting force is imparted in order to pivot the spray nozzle 50 is only tangentially relevant to the inventive aspects of the present sprayer, this aspect is nevertheless briefly addressed. In some versions, the angle of the nozzle 50 can be changed manually by a user's directly grasping and pivoting the nozzle 50 and/or the pivot-head rotating component 120. In other versions, the nozzle 50 is pivoted remotely through mechanical linkage. Examples of mechanisms and linkages through which the nozzle 50 can be remotely pivoted can be seen in U.S. Pat. No. 6,976,644 granted to Troudt on Dec. 20, 2005; U.S. Pat. No. 8,708,254 granted to Baxter et al. on Apr. 29, 2014; and U.S. Publication No. 2007/0170288 A1 published under the name of Troudt on Jul. 26, 2007. In the illustrative embodiment of FIGS. 1 and 2, a nozzle actuator 160 is disposed about the rigid fluid conduit 20 for axial reciprocation along the conduit axis $A_C$. The pivot-head rotating component 120 has extending therefrom a nozzle lever 150. A drive rod 180 mutually links the nozzle actuator 160 and the nozzle lever 150 such that axial displacement of the nozzle actuator 160 along the conduit axis $A_C$ causes the nozzle 50 to pivot about the nozzle-pivot axis $A_{NP}$.

As indicated in all of FIGS. 1 through 5, the attachment-mounting arm 70 is configured for removably retaining a surface-engaging attachment 200, which attachment 200 is in turn configured for engaging a surface (not shown) to be cleaned. An illustrative, non-limiting set of surface-engaging attachments 200 includes a brush, a sponge, and a mop. In each of various embodiments, an attachment 200 configured for retention by the attachment-mounting arm 70 comprises a platform 210 and a mounting post 220 attached to and extending from the platform 210.

Figures 3, 3A:
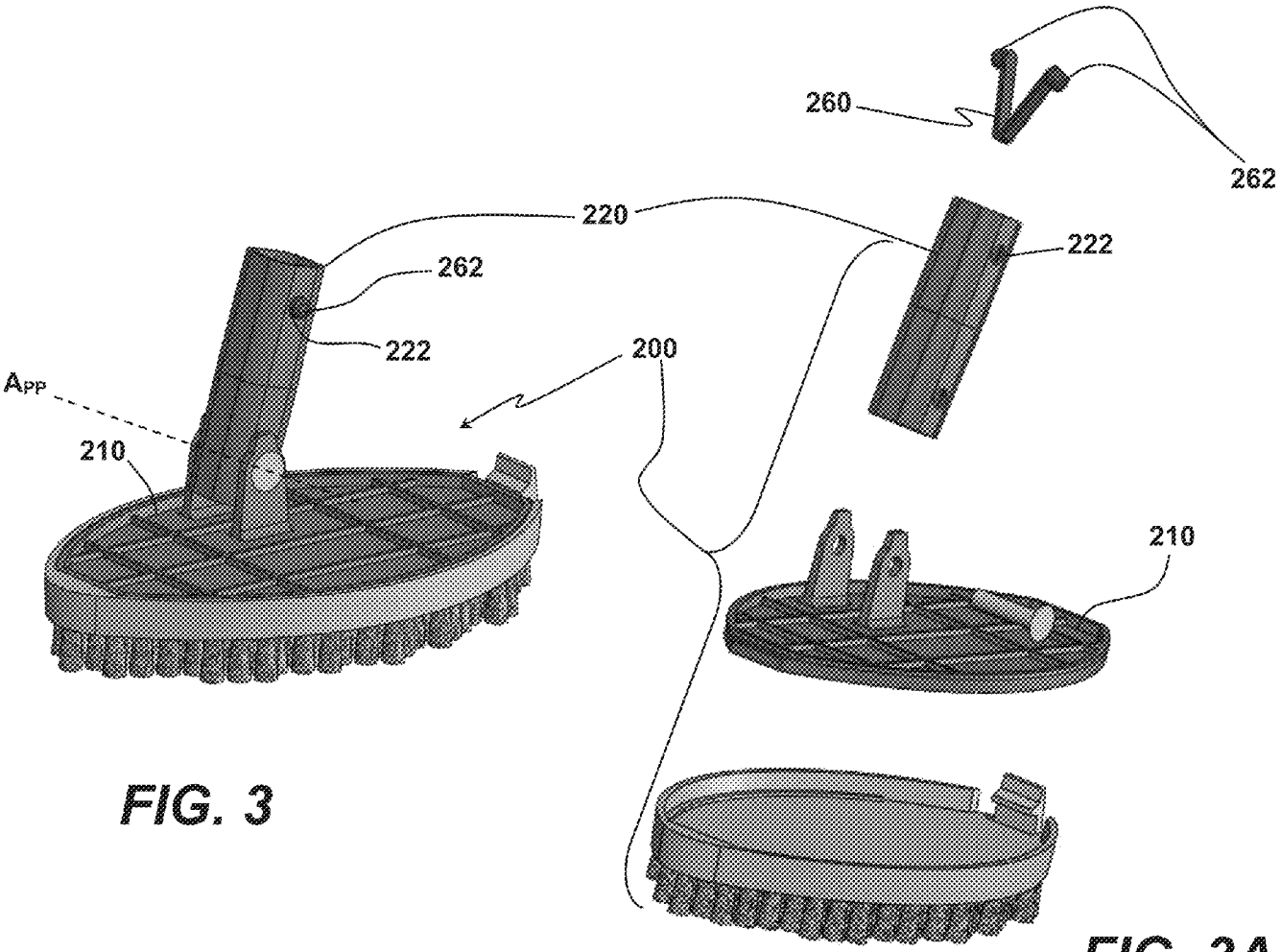
FIG. 3 is an assembled view of an illustrative surface-engaging attachment configured for selective retention by the attachment-mounting arm of the sprayer of FIGS. 1-2A.
FIG. 3A is a exploded or disassembled view of the attachment of FIG. 3.

Exemplified by the version of FIGS. 3 and 3A, wherein FIG. 3A is an exploded view of FIG. 3, is an attachment 200 in which the platform 210 and mounting post 220 are pivotably connected to one another for relative angular movement about a post-pivot axis $A_{PP}$. In the example of FIGS. 3 and 3A, the mounting post 220 pivots relative to the platform 210 about a single post-pivot axis $A_{PP}$, but it is to be appreciated that versions in which the mounting post 220 pivots about "at least one" post-pivot axis $A_{PP}$ are within the scope and contemplation of the invention. For example, angular movement about an infinite number of pivot axes $A_{PP}$ is realizable with a ball-and-socket or other universal-type joint (not shown).

Figure 5:
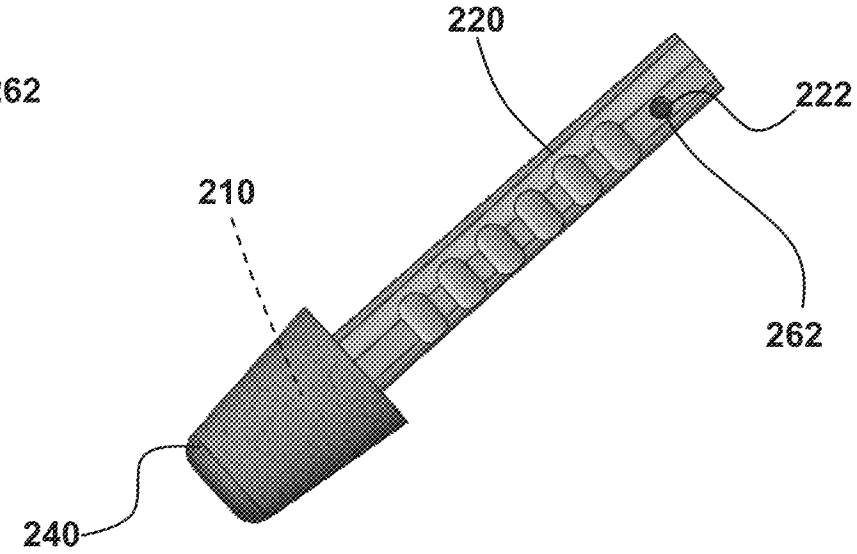
FIG. 5 shows an illustrative surface-engaging attachment different form the attachments of FIGS. 3, 3A and 4.
Figure 4:
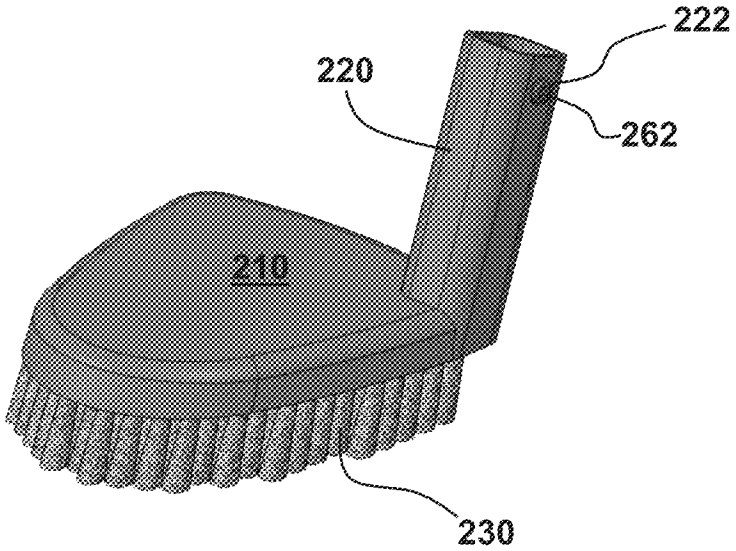
FIG. 4 depicts an illustrative surface-engaging attachment alternative to the attachment of FIGS. 3 and 3A.

Shown in FIGS. 4 and 5 are two examples of surface-engaging attachments 200 in which the mounting post 220 depends from, and is angularly fixed relative to, the platform 210. FIG. 4 depicts an illustrative first brush 230 suitable for scrubbing relatively large, flat surfaces, while FIG. 5 shows an illustrative second, detail brush 240 for cleaning within otherwise difficult-to-access spaces, such as between wheel spokes.

As shown in FIGS. 1-3, the mounting post 220 of a surface-engaging attachment 200 of the general type depicted in FIGS. 3-5 is selectively coupleable to the attachment-mounting arm 70. More specifically, in the illustrative examples, the mounting post 220 is telescopically received into the attachment-mounting arm 70. However, within the scope and contemplation of the invention are versions in which the arm 70 is telescopically received into the mounting post 220. Depiction in the drawings of the former, post-in-arm arrangement are regarded as sufficient disclosure to a person of ordinary skill in the related art of the latter, arm-in-post arrangement, and are therefore considered within the scope of the appended dams in the absence of express limitations to the contrary. Either arrangement—post-in-arm or arm-in-post—may be alternatively and more generally referred to as "telescopically coupled."

In various versions, the telescopic coupling between the attachment-mounting arm 70 and the mounting post 220 of a surface-engaging attachment 200 may be selectively retained by any of a set of alternatively-configured clips. As with the manner in which the nozzle 50 is pivoted, the precise manner and mechanisms by which telescopic coupling is selectively retained is quite secondary to the central inventive aspects. However, because an illustrative manner of retention is depicted, it warrants brief treatment.

With reference again to FIGS. 3 and 3A, the latter of which is an exploded or "dissembled" view of the former, the mounting post 220 contains a "V-clip" 260 fabricated from a resilient material and including opposed, outwardly-directed V-clip protrusions 262. The V-clip 260 is inserted into the mounting post 220 under compression such that the V-clip protrusions 262 are outwardly-biased (i.e., mechanically biased away from one another) and protrude through post apertures 222 on opposite sides of the mounting post 220. With additional reference to FIGS. 1 and 2A, the attachment-mounting arm 70 includes at least one pair of mutually opposed arm apertures 78 that align with the post apertures 220. The V-clip protrusions 262 are sufficiently long to extend through the post apertures 222 and into the arm apertures 78 in order to create a selective interference fit therewith and prevent axial displacement of the post 220 relative to the attachment-mounting arm 70 along the arm axis $A_A$. When separation of the mounting-post 220 and attachment-mounting arm 70 is desired, a user squeezes the V-clip protrusions 262 toward each other and urges the mounting-post 220 and attachment-mounting arm 70 toward separation in order to free the interference fit.

The foregoing is considered to be illustrative of the principles of the invention. Furthermore, since modifications and changes to various aspects and implementations will occur to those skilled in the art without departing from the scope and spirit of the invention, it is to be understood that the foregoing does not limit the invention as expressed in the appended claims to the exact constructions, implementations and versions shown and described.

What is claimed is:

1. A fluid sprayer comprising:

a rigid fluid conduit extending along a conduit axis between longitudinally opposed open conduit first and second ends;

a nozzle having a fluid-expulsion bore and being connected to the conduit second end such that (a) the nozzle can pivot about a nozzle-pivot axis that extends orthogonally to the conduit axis and (b) fluid introduced into the conduit first end is expelled through the fluid-expulsion bore; and an attachment-mounting arm connected to the fluid conduit for pivotal movement about an arm-pivot axis having a component of spatial extension orthogonal to the conduit axis and being collinear with the nozzle-pivot axis and longitudinally non-displaceable relative to the rigid fluid conduit.

2. The sprayer of claim 1 wherein the attachment-mounting arm is (i) selectively lockable into a plurality of discrete angular positions relative to the conduit axis; and (ii) configured to removably retain a surface-engaging attachment configured for engaging a surface to be cleaned.

3. The sprayer of claim 2 wherein (i) a surface-engaging attachment configured for retention by the attachment-mounting arm comprises a platform and a mounting post attached to and extending from the platform; and (ii) the attachment-mounting arm and mounting post are selectively coupleable to one another such that one of the attachment-mounting arm and mounting post is telescopically received into the other of the mounting post and attachment-mounting arm.

4. The sprayer of claim 3 wherein the mounting post is fixedly attached to the platform.

5. The sprayer of claim 3 wherein the mounting post and platform are pivotably connected to one another for angular movement about at least one post-pivot axis.

6. The sprayer of claim 1 wherein (i) the attachment-mounting arm extends between first and second arm ends along an arm axis;

(ii) the first end of the attachment-mounting arm includes a bore extending transversely to the arm axis and being defined by a cylindrical interior bore surface; and (iii) depending from the rigid conduit is an axle that extends transversely to the conduit axis and includes a cylindrical exterior axle surface configured for receiving the interior bore surface thereover such that the cylindrical interior bore and exterior axle surfaces are coaxially centered on the arm pivot axis and the interior bore surface defines a hub that is pivotable about the axle.

7. The sprayer of claim 6 wherein (i) the hub defines at least one of a notch and protrusion;

(ii) the axle defines at least one of a protrusion and notch; and (iii) the hub is axially displaceable over the axle along the arm-pivot axis between an axial first position in which arm pivoting is prevented by an engaged interference fit between one of a protrusion and notch defined by the axle and the other of a notch and protrusion defined by the hub and an axial second position in which the interference fit is disengaged so that the arm is free to pivot about the arm-pivot axis for selective locking into disparate angular positions.

8. The sprayer of claim 7 wherein the hub is normally biased toward the axial first position.

9. A fluid sprayer comprising:

a fluid conduit extending along a conduit axis between longitudinally opposed open conduit first and second ends;

a nozzle having a fluid-expulsion bore and being connected to the conduit second end such that (a) the nozzle can pivot about a nozzle-pivot axis that extends orthogonally to the conduit axis and (b) fluid introduced into the conduit first end is expelled through the fluid-expulsion bore; and an attachment-mounting arm connected to the fluid conduit for pivotal movement about an arm-pivot axis having a component of spatial extension orthogonal to the conduit axis and being collinear with the nozzle-pivot axis and a common pivot axis, wherein (i) the attachment-mounting arm extends between first and second arm ends along an arm axis;

(ii) the first end of the attachment-mounting arm includes a bore extending transversely to the arm axis and being defined by a cylindrical interior bore surface;

(iii) depending from the rigid conduit is an axle that extends transversely to the conduit axis and includes a cylindrical exterior axle surface configured for receiving the interior bore surface thereover such that the cylindrical interior bore and exterior axle surfaces are coaxially centered on the arm pivot axis and the interior bore surface defines a hub that is pivotable about the axle;

(iv) the hub defines at least one of a notch and protrusion;

(v) the axle defines at least one of a protrusion and notch;

(vi) the hub is axially displaceable over the axle along the arm-pivot axis between an axial first position in which arm pivoting is prevented by an engaged interference fit between one of a protrusion and notch defined by the axle and the other of a notch and protrusion defined by the hub and an axial second position in which the interference fit is disengaged so that the arm is free to pivot about the arm-pivot axis for selective locking into disparate angular positions; and (vii) the hub is normally biased toward the axial first position.

10. The Sprayer of claim 9 wherein the longitudinal position of the arm-pivot axis is fixed relative to the conduit.

11. The sprayer of claim 9 wherein the attachment-mounting arm is (i) configured to removably retain a surface-engaging attachment configured for engaging a surface to be cleaned;

(ii) the surface-engaging attachment comprises a platform and a mounting post attached to and extending from the platform; and (iii) the attachment-mounting arm and mounting post are selectively coupleable to one another such that one of the attachment-mounting arm and mounting post is telescopically received into the other of the mounting post and attachment-mounting arm.

* * * * *